United States Patent [19]

Wernicke et al.

[11] 4,257,871

[45] Mar. 24, 1981

[54] USE OF VACUUM RESIDUE IN THERMAL CRACKING

[75] Inventors: Hans J. Wernicke, Wolfratshausen; Klaus D. Mikulla, Geretsried, both of Fed. Rep. of Germany

[73] Assignee: Linde Aktiengesellschaft, Wiesbaden, Fed. Rep. of Germany

[21] Appl. No.: 82,454

[22] Filed: Oct. 9, 1979

[30] Foreign Application Priority Data

Oct. 6, 1978 [DE] Fed. Rep. of Germany ..... 2843793

[51] Int. Cl.[3] ..... C10G 69/06

[52] U.S. Cl. ..... 208/57; 208/86; 585/251; 585/324

[58] Field of Search ..... 208/57, 86; 585/251, 585/324, 650

[56] References Cited

U.S. PATENT DOCUMENTS

| | | | |
|---|---|---|---|
| 2,871,182 | 1/1959 | Weekman | 208/50 |
| 3,288,703 | 11/1966 | Spars et al. | 208/86 |
| 3,720,729 | 3/1973 | Sze et al. | 585/275 |
| 3,781,195 | 12/1973 | Davis et al. | 585/270 |
| 3,898,299 | 8/1975 | Jones | 585/251 |
| 4,167,533 | 9/1979 | Raymond | 585/251 |
| 4,210,520 | 7/1980 | Wernicke et al. | 208/57 |

*Primary Examiner*—Herbert Levine
*Attorney, Agent, or Firm*—Millen & White

[57] ABSTRACT

Vacuum residue is used for production of olefins by first separating, preferably by solvent extraction, the asphalt therein, blending resultant asphalt depleted fraction with a lighter fraction, e.g., a vacuum gas oil, and then subjecting the blend to a conventional catalytic hydrogenation step prior to thermal cracking. The hydrogenate may be separated into fractions with the heavy fraction only being thermally cracked.

10 Claims, No Drawings

USE OF VACUUM RESIDUE IN THERMAL CRACKING

CROSS REFERENCE TO RELATED APPLICATION

Attention is directed to a commonly assigned application filed Oct. 9, 1979, Ser. No. 82,453, entitled "Thermal Cracking of Heavy Fraction of Hydrocarbon Hydrogenate" by Hans Juergen Wernicke, Walter Kreuter and Claus Schliebener, based on German application No. P 28 43 792.5, filed Oct. 6, 1978, the contents of said commonly assigned application being incorporated by reference in this application.

BACKGROUND OF THE INVENTION

This invention relates to the production of olefins by the thermal cracking of heavy hydrocarbon mixtures wherein the starting mixture is first subjected to hydrogenation.

To produce olefins, it is conventional and advantageous to employ light hydrocarbons, such as, for example, ethane or propane, or hydrocarbon mixtures having a boiling point of below 200° C., such as, for example, naphtha, as starting materials for a thermal cracking operation. These starting materials result in a high yield in olefins and relatively few undesirable by-products.

However, in view of the high demand for olefins, which may lead to a short supply and increase in price of the aforementioned advantageous starting materials, several attempts have been made through the years to develop processes which permit the utilization of higher-boiling starting materials.

When employing such higher-boiling charges, the olefin yield is reduced and the yield of liquid hydrocarbons boiling above 200° C. is increased. The proportion of the latter high-boiling fraction, which is difficult to treat in further operation, increases significantly with the boiling point of the starting material. In addition, further difficulties are encountered in that higher-boiling starting materials lead to increased formation of coke and tar. These products are deposited on the walls of the conduit elements, for example, pipelines and heat exchangers, thereby impairing heat transfer, and furthermore resulting in constrictions in cross section. It is therefore necessary to conduct a removal of these deposits more frequently than when using light hydrocarbons.

In order to solve this problem, DOS [German Unexamined Laid-Open Application] No. 2,164,951 describes a process wherein the starting material is catalytically hydrogenated prior to the thermal cracking thereof. By virtue of this pretreatment, there is affected a reduction in the content of aromatic compounds in the starting material, otherwise leading to undesired cracked products. Moreover, a desulfuration of the starting material occurs.

In U.S. Pat. No. 3,898,299, a process is described wherein atmospheric petroleum residue feedstock is hydrogenated, then subjected to vacuum distillation to recover a distillate boiling below 650° C. at atmospheric pressure, and only this distillate is subjected to thermal cracking. In this patent, it is also pointed out on Column 1, lines 45–47 that the carbon in the vacuum residue is lost to olefins production.

SUMMARY OF THE INVENTION

An object of this invention is to provide an improved thermal cracking system, especially a system based on the utilization of a vacuum residue wherein carbon therein is used for olefins production.

Further objects include providing intermediate compositions of matter and processes for producing same.

Upon further study of the specification and appended claims, further objects and advantages of this invention will become apparent to those skilled in the art.

To attain these objects, the vacuum residue prior to hydrogenation, is subjected to a separation to remove asphalt components therein; the resultant asphalt-depleted vacuum residue is blended with a vacuum gas oil or substantial equivalent thereof; the blend is then hydrogenated; and the resultant hydrogenate is at least partially subjected to thermal cracking.

In a preferred aspect of this invention, a vacuum gas oil is employed for blending purposes, both the vacuum gas oil and the vacuum residue being obtained conventionally by vacuum distillation of an atmospheric residue.

Thus, the process of this invention demonstrates that much heavier crude oil components than conventionally employed can be utilized for thermal cracking to produce olefins. That the vacuum residue is utilizable is indeed surprising in view of U.S. Pat. No. 3,898,299. Furthermore, hydrogenation prior to vacuum distillation is not required in this invention.

In order to work up the vacuum residue, it is necessary, at the outset, to remove the asphaltic components from this fraction, since these components would otherwise deposit out on various parts of the plant and also on the hydrogenation catalyst.

In accordance with a special aspect of this invention, the asphalt components are separated by means of solvent extraction.

It has been found that thus-extracted asphalt-depleted vacuum residue contains up to 40% by weight of paraffinic and naphthenic components, yielding high amounts of olefin product during thermal cracking. Furthermore, this fraction contains aromatics, essentially polyaromatics, which can be worked up into crackable components by the hydrogenation step.

On the basis of the chemical structure of the asphalt-depleted vacuum residue, it appears desirable to utilize this fraction as well to attain a maximum of cracked product yield with a minimum of raw material employed. As has been found by experiments, no insurmountable technical problems are encountered during hydrogenation or during the subsequent thermal cracking step, which problems are due to the high initial boiling point of the extracted vacuum residue, e.g., in the general range of about 520°–580° C. (1013 m bar). Rather, it was found that when mixing this fraction with the vacuum gas oil obtained during vacuum distillation, a fraction is obtained in total, the further processing of which can be accomplished under essentially conventional conditions. It may merely be necessary during the thermal cracking step to operate at vapor dilutions which are higher than in case of light starting materials, e.g. $\geqq$0.7 kg/kg (usually in the range of 0.8–1.5 kg/kg).

During the treatment of the vacuum residue, an extraction residue is obtained which can be utilized as bitumen, or which can also serve as a hydrogen source for the hydrogenation, if it is converted into a gaseous mixture by way of a partial oxidation.

The extraction of the vacuum residue can be conducted with nonpolar solvents. In an advantageous further development of the process of this invention, $C_3$- to $C_6$-hydrocarbons are employed for this purpose. In this connection, the yield in extracted vacuum residue, but also the content of heavy metals, asphaltic substances, sulfur, and nitrogen in this fraction, increase with the number of carbon atoms in the solvent hydrocarbon employed. For example, in case of high concentrations of heavy metals and/or asphalt components in the vacuum residue, a $C_3$ hydrocarbon is employed; when low concentrations are encountered, a $C_6$ hydrocarbon is employed, and at medium concentrations, a $C_4$ or $C_5$ hydrocarbon or mixture of $C_3$ to $C_6$ hydrocarbons are utilized as the solvent.

Appropriate pressures are employed to maintain the liquid phase for the solvents during these extractions. Preferred extraction temperatures in case of extraction by $C_3$ are usually in the range of 30° to 80° C., especially 40° to 65° C., and extraction pressures in the case of extraction by $C_3$ are usually in the range of 20–35 bar.

It is accordingly possible to affect the quality of the extracted vacuum residue by the choice of extractant. Use is made of this feature in a further development of the process of this invention, wherein the quality of the extracted vacuum residue, after blending same with the vacuum gas oil, determines the selection of the extractant for the respective hydrocarbon mixture starting material. After blending the two fractions, the content of asphalt components and heavy metals is to correspond approximately to the maximally permissible content of these components, defined as that content, wherein for conventional catalyst lifetimes (1–2 years), there are not yet any substantial impediments to the hydrogenation reactions. Such maximally permissible contents range, for example, in case of asphalt components about 0.05% by weight and in case of vanadium on the order of 2–3 ppm by weight. Of course, less than the maximum contents can also be employed.

The weight ratio of blending agent, e.g., vacuum gas oil, to extracted vacuum residue depends on the processed crude and varies within wide ranges. Typical weight ratios are 2:1 to 4:1.

Aside from vacuum gas oil as a blending agent, any hydrocarbon blending agent can be used. For this purpose, other blending agents comprise, but are not limited to other straight run distillates and distillates from cracking processes such as visbreaking and coking.

In a favorable further development of the process of this invention, the further treatment of the blend of vacuum gas oil and extracted vacuum residue is conducted in accordance with the process of the above cross referenced, commonly assigned application; special reaction conditions for hydrogenation followed by separating the hydrogenation product into a light fraction and a heavy fraction, only the heavy fraction being conducted to the thermal cracking stage. Utilizing the blends of this invention, as high as 50% by weight of naphthenes can be realized as the heavy fraction sent to the thermal cracking stage.

Without further elaboration, it is believed that one skilled in the art can, using the preceding description, utilize the present invention to its fullest extent. The following preferred specific embodiment is, therefore, to be construed as merely illustrative, and not limitative of the remainder of the disclosure in any way whatsoever.

The starting material in all cases is a crude oil of which, after separating the atmospheric boiling cuts, 51% by weight is obtained as atmospheric residue. Of this amount, based on the crude, 29% by weight is vacuum gas oil and 22% by weight is vacuum residue. These two fractions are separated in a vacuum distillation stage. Characteristic properties of the thus-obtained vacuum gas oil and vacuum residue are contained in Table 1, column (1) (vacuum gas oil) and column (2) (vacuum residue), respectively.

TABLE 1

| | | (1) | (2) | (3) |
|---|---|---|---|---|
| Density (15° C.) | g/ml | 0.914 | 1.07 | 0.930 |
| Boiling range | °C. | 360–540 | >540 | >360 |
| C | % by wt. | 85.8 | 87.0 | 85.9 |
| H | " | 12.3 | 10.0 | 11.7 |
| S | " | 1.8 | 2.8 | 2.3 |
| N | " | 0.1 | 0.2 | 0.1 |
| V | ppm by wt. | 0.1 | 290 | 1.9 |
| Paraffins and Naphthenes | % by wt. | 48 | | 38 |
| Monoaromatics | " | 17 | | 15 |
| Polyaromatics | " | 35 | | 47 |
| Polymeric compounds | " | >0.05 | | 0.05 |

The vacuum residue was then treated with an extractant consisting of 35 molar percent propane and 65 molar percent butane. The process was conducted in a countercurrent extraction column under a pressure of 30 bar, the temperatures being 45° C. in the sump and 75° C. in the head of the column.

Under these conditions, an extraction residue was formed from the vacuum residue, the proportion of the former being 41% by weight, whereas 59% by weight was withdrawn as extracted vacuum residue and blended with the vacuum gas oil. The blend, composed of 69% by weight of vacuum gas oil and 31% by weight of extracted vacuum residue has characteristic properties indicated in Table 1, column (3).

This fraction was subsequently hydrogenated. For this purpose, the mixture was conducted, under a pressure of 80 bar and at a temperature of 400° C. with an hourly rate per unit volume of 0.8 liter of hydrogenation starting material per liter of catalyst material, over a catalyst, the latter containing, as hydrogenation-active components, nickel and molybdenum on an acidic support. During the hydrogenation, 275 $Nm^3$ of hydrogen was consumed per ton of hydrogenation starting material.

The hydrogenation product contained 2.2% by weight of $H_2S$; 0.1% by weight of $NH_3$; 2.4% by weight of $C_1$–$C_4$-hydrocarbons; furthermore in liquid components 30.4% by weight of a gasoline fraction with $C_5$— and heavier hydrocarbons with a final boiling point of 200° C.; 45.1% by weight of a fraction boiling between 200° and 340° C., and 19.8% by weight of components boiling at above 340° C.

The essential characteristics of the gasoline fraction ($C_5$—200° C.) are indicated in Table 2, column (1).

The components of the hydrogenation product boiling at above 200° C. were used as starting material for the thermal cracking process. The most important properties of this fraction are listed in column (2) of Table 2.

TABLE 2

| | | (1) | (2) |
|---|---|---|---|
| Density (15° C.) | g/ml | 0.738 | 0.797 |
| Boiling range | °C. | $C_5$–200 | 200–480 |

TABLE 2-continued

| | | (1) | (2) |
|---|---|---|---|
| C:H | g/g | 6.39 | 6.10 |
| S | ppm by wt. | 40 | 205 |
| N | ppm by wt. | | 100 |
| O | % by wt. | <0.1 | |
| Paraffins | % by wt. | 67.1 | 82 |
| Naphthenes | % by wt. | 12.8 | |
| Monoaromatics | % by wt. | 20.1 | 15 |
| Polyaromatics | % by wt. | — | 3 |
| Iso-/n-Paraffins | g/g | 4.3 | |
| RON clear | | 82 | |

For conducting a cracking step in a heated tubular cracking reactor, the starting material was diluted with 0.8 part by weight of steam per part by weight of hydrocarbon and conducted through the reactor at a residence time of 0.2 second. The outlet temperature was 830° C. The cracked product contained, as valuable components, 9.5% by weight of methane, 28.1% by weight of ethylene, and 14.8% by weight of propylene. The residual fraction boiling at above 200° C. was merely 12.3% by weight of the initial cracking material.

The preceding examples can be repeated with similar success by substituting the generically and specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process comprising subjecting a normally liquid hydrocarbon mixture to a hydrogenation treatment and to a subsequent thermal cracking step to produce normally gaseous olefins, the improvement which comprises employing as said normally liquid hydrocarbon mixture a blend of substantially asphalt-free vacuum residue having an initial boiling point of at least about 520° C. with a hydrocarbon blending agent having a lower initial boiling point than said substantially asphalt-free vacuum residue, both said substantially asphalt-free vacuum residue and said hydrocarbon blending agent being derived from an atmospheric residue.

2. A process according to claim 1, wherein the substantially asphalt-free vacuum residue is produced by solvent extracting a vacuum residue with a nonpolar solvent made up of $C_3$-, $C_4$-, $C_5$-, or $C_6$-hydrocarbons.

3. A process according to claim 2, wherein in case of high concentrations of heavy metals and/or asphalt components in the vacuum residue, a $C_3$-hydrocarbon solvent is employed.

4. A process according to claim 2, wherein at low concentrations of heavy metals and/or asphalt components, a $C_6$-hydrocarbon solvent is employed.

5. A process according to claim 2, wherein at medium concentrations of heavy metals and/or asphaltic components, a $C_4$- or $C_5$-hydrocarbon or mixtures of $C_3$- to $C_6$-hydrocarbons are utilized as the solvent.

6. A process according to claim 1, wherein the hydrocarbon blending agent is a vacuum gas oil.

7. A process according to claim 1, wherein the blend contains not more than about 0.05% by weight of asphaltic materials and not more than about 3 ppm of vanadium.

8. A process according to claim 7, wherein the hydrocarbon blending agent is a vacuum gas oil.

9. A process according to claim 1, wherein the weight ratio of said blending agent to said substantially asphalt-free vacuum residue is 2:1 to 4:1, respectively.

10. A process according to claim 6, wherein the weight ratio of said blending agent to said substantially asphalt-free vacuum residue is 2:1 to 4:1, respectively.

* * * * *